US006135446A

United States Patent [19]

Thiemann et al.

[11] Patent Number: 6,135,446

[45] Date of Patent: Oct. 24, 2000

[54] ALIGNING DEVICE

[75] Inventors: Peter Thiemann, Munich; Otto Olbrich, Taufkirchen; Stefan Hajdukiewicz; Georg Boehmer, both of Munich, all of Germany

[73] Assignee: Oce Printing Systems GmbH, Poing, Germany

[21] Appl. No.: 09/284,923

[22] PCT Filed: Oct. 22, 1997

[86] PCT No.: PCT/DE97/02459

§ 371 Date: Jun. 8, 1999

§ 102(e) Date: Jun. 8, 1999

[87] PCT Pub. No.: WO98/18053

PCT Pub. Date: Apr. 30, 1998

[30] Foreign Application Priority Data

Oct. 22, 1996 [DE] Germany ..... 196 43 626

[51] Int. Cl.[7] ..... B65H 7/02

[52] U.S. Cl. ..... 271/228; 271/242; 271/274

[58] Field of Search ..... 271/227, 228, 271/242, 252, 273, 274

[56] References Cited

U.S. PATENT DOCUMENTS

| | | | |
|---|---|---|---|
| 4,685,664 | 8/1987 | Petersdorf | 271/227 |
| 4,805,892 | 2/1989 | Calhoun | 271/242 |
| 5,094,442 | 3/1992 | Kamprath . | |
| 5,219,159 | 6/1993 | Malachowski et al. | 271/242 |
| 5,280,899 | 1/1994 | Kida et al. . | |
| 6,019,365 | 1/2000 | Matsumura | 271/227 |

FOREIGN PATENT DOCUMENTS

| | | | |
|---|---|---|---|
| 0 658 503 | 6/1995 | European Pat. Off. . | |
| 32 23 048 A1 | 12/1983 | Germany . | |
| 32 23 048 C2 | 12/1983 | Germany . | |
| 0172144 | 7/1989 | Japan | 271/242 |
| 404049145 | 2/1992 | Japan | 271/228 |

OTHER PUBLICATIONS

Patent Abstracts of Japan, 05124752, entitled Paper Aligning Unit for Image Forming Device, Kogure Yoshio, published May 21, 1993.

Patent Abstracts of Japan, 04260558, entitled "Sheet Position Compensating Device," Takashina Shinji, published Sep. 16, 1992.

Patent Abstracts of Japan, 61249064, entitled "Image Forming Device Equipped with Sheet Matching Mechanism", Kusumoto Toshihiko, published Jun. 11, 1986.

*Primary Examiner*—H. Grant Skaggs

*Attorney, Agent, or Firm*—Hill & Simpson

[57] ABSTRACT

The invention relates to an aligning device (10) for individual sheet (12) alignment. The alignment device (10) comprises a sensor device (22, 24, 26, 28), a delivery device (18), and a transport device (14) located downstream from the delivery device in the direction of conveyance of the sheet (12). In order to align the sheet (12) the sensor device (22, 24, 26, 28) detects the side end of the sheet so that its position can be determined in relation to a desired printing position. The transport device (14) holding the sheet (12) is shifted in relation to the direction (16) in which the sheet (12) is conveyed so that the sheet (12) can be moved into the desired printing position. Before the sheet (12) is aligned the delivery device (18), which feeds the sheet (12) to the transport device (14), is opened.

20 Claims, 2 Drawing Sheets

ALIGNING DEVICE

FIELD OF THE INVENTION

The invention is directed to an aligning device, particularly for a single-sheet printer or copier, for aligning a single sheet of the recording medium.

BACKGROUND OF THE INVENTION

In a single-sheet printer or a copier to which a respective, single sheet of the recording medium, for example a single sheet of paper, is supplied for printing or, respectively, copying, there is often the problem that the recording medium is drawn in into the single-sheet printer or, respectively, copier at an angle or offset. Due to the angled or offset draw-in of the recording medium, this assumes a position that deviates from a rated printing position wherein the recording medium can be properly printed. Since a proper printing of the recording medium is only possible in the rated printing position, it is particularly pre-print forms or recording media that are already printed with ink and onto which successor colors are to be printed can no longer be printed error-free.

Various devices are known for solving this problem. U.S. Pat. No. 4,805,895, thus, discloses a means in a printer with which a sheet that is displaced transversely relative to the rated printing position can be aligned. The means is formed of a delivery device and of a transport device that follows this as viewed in conveying direction and that can be moved transversely relative to the conveying direction. During the transport of the sheet, the delivery device is operated at a higher conveying speed than the transport device, so that a loop forms between the two devices, this loop enabling a movement of the transport device transversely relative to the conveying direction without damaging the sheet to be aligned. For aligning the sheet, the transport device transporting the sheet to be aligned is moved transversely relative to the conveying direction in conformity with the previously identified offset.

EP-A-0 658 503 discloses an aligning device for copier devices with which a sheet drawn in at an angle with respect to the conveying direction can be aligned parallel to the conveying direction. The aligning device is formed of two driven roller pairs that are arranged on a common line transversely relative to the conveying direction and respectively seize an edge region of the sheet to be aligned. For aligning the sheet parallel to the conveying direction, the two roller pairs are driven with different conveying speeds, so that the one edge region of the sheet is retarded or accelerated compared to the other edge region of the sheet.

DE 32 23 048 C2 discloses an aligning device for copier devices wherein the position of individually supplied sheets of a recording medium can be modified before printing with a conveyor means displaceable transversely to the conveying direction. Given this known aligning device, the sheet is first aligned parallel to the conveying direction. To that end, the conveying nip of the conveying device proceeding transversely, i.e. roughly perpendicularly to the conveying direction is closed, so that a contact line forms between the conveyor units. This contact line between the conveyor unit forms the stop for the leading edge of the sheet. When a recording medium sheet is then placed into the copier device, it is drawn in with the delivery device preceding the conveyor device and is conveyed in the direction of the conveyor device. The delivery device only ends the conveying event when the sheet arcs between te delivery device and the conveyor device. As a result thereof, the arced recording medium sheet is under tension and has its leading edge lying uniformly against the contact line between the conveyor units of the conveyor device. Subsequently, the sheet is ceased by the conveyor device and conveyed into the copier device. During this conveying event, a sensor device acquires the lateral edge of the sheet and identified the position thereof transversely relative to the conveying direction and relative to the rated printing position. When the identified position transversely relative to the conveying direction does not correspond to the rated printing position, the conveyor device holding the sheet is stopped and is displaced transversely relative to the conveying direction to such an extent that the position of the sheet corresponds to the rated printing position. The conveying event is subsequently continued.

Given this known aligning device, the distance between the delivery device and the conveyor device following the transport device that transports the sheet into the copier device must be greater than the maximally possible length of a single sheet. Only in this way is it assured that neither the delivery device nor the conveyor device hold the sheet while it is being aligned transversely relative to the conveying direction by the transport device. Otherwise, the sheet would be damaged during the alignment. Consequently, the structural length of the aligning device is dependent on the maximum sheet length and is fashioned correspondingly large. At the same time, shorter sheets that are less than half as long as the sheets with the maximum length are not transported by the aligning device, since the handover of such a short sheet from the delivery device to the transport device or from the latter to the conveying device fails.

Therefore, there is a need for an aligning device whose structural length is comparatively slight and that can align sheets of greatly differing length in a simple way.

SUMMARY OF THE INVENTION

The present invention satisfies the aforenoted need by providing a delivery device that is adjustable from a transport position into an open operating position wherein it releases the sheet after being ceased by the transport device.

In an embodiment, the present invention provides an aligning device for a single-sheet printer or copier which aligns a single sheet of a recording medium, such as a piece of paper. The aligning device of the present invention comprising a sensor means that acquires the lateral edge of the sheet in order to identify the position thereof relative to a rated printing position. The aligning device also comprises a conveyor means displaceable transversely relative to the conveying direction of the sheet. The conveyor means can also hold the sheet so that it can be aligned into the rated printing position dependent on the identified position. The conveyor means also comprises two conveyor units arranged lying opposite one another and contacting one another in a contact line proceeding transversely relative to the conveying direction, whereby the contacting line forms a stop for the leading edge of the sheet. The aligning device also comprises a delivery means for delivering the sheet to the conveyor means. The delivery means conveying—in conveying direction—the sheet before it is stopped by the conveyor units to such an extent that the sheet arcs between the delivery means and the conveyor means and aligns at the contact line.

In the invention, the delivery device releases the sheet to be aligned after it has been ceased by the transport device. As a result thereof, it is assured in a simple way that the sheet is held only by the transport device during the alignment transverse relative to the conveying direction. In the structural arrangement of the delivery device relative to the transport device, further, no attention need be paid to the actual sheet length, so that, on the one hand, sheets differing greatly in length can be aligned and, on the other hand, the distance of the delivery device from the transport device can be kept small, as a result whereof a short structural length is possible for the aligning device.

In a preferred embodiment, the delivery device has two conveyor units proceeding transversely relative to the transport direction of the sheet. At least one of the two conveyor units can be moved between the transport position wherein it lies against the other conveyor unit an the open operating position wherein it is held at a distance from the other conveyor unit. For example, rotatably seated conveyor rollers are suitable as conveyor units, at least one thereof being driven. Further, the employment of conveyor belts or tractor units is possible. It is also advantageous given this embodiment when a tensing element that pre-stresses the movable conveyor unit into the transport position is provided at the delivery device. Further, at least one actuator unit that moves the movable conveyor unit into the open operating position against the force of the tensing element is provided at the delivery device. In this way, it is assured that the delivery device is ready to transport at any time and is in the open operating position only during the alignment of the sheet.

It is also proposed that a tensing device is provided at the alignment device, this tensing device holding the transport device—before it ceases the sheet—in an initial position transversely relative to the conveying direction in which the transport device is arranged aligned approximately centrally relative to the conveying path along which the sheet is conducted through the alignment device. During the actual alignment of the sheet, the transport device is then displaced opposite the force of the tensing device. In this embodiment of the aligning device, the tensing device assures that the transport device is in a defined initial position before it ceases the recording medium. Further, the transport device must be moved opposite the force of the tensing device when being displaced transversely relative to the transport device so that it is mechanically clamped. An especially high positioning precision is achieved as a result thereof. Suitable tensing devices include hydraulic or mechanical spring elements that are respectively arranged at the two face sides of the transport device, secured to the frame of the aligning device.

The sensor means preferably has a first edge sensor that is arranged preceding the transport device as viewed in conveying direction. This first edge sensor acquires the position of the lateral edge of the sheet relative to the rated print position at the beginning of the alignment of the sheet. It is also advantageous when the sensor means has a second edge sensor arranged following the transport device as viewed in conveying direction, this only identifying the position of the lateral edge of the sheet when the transport device supplies the sheet to the transfer printing location of the single-sheet printer or, respectively, copier. As a result thereof, it is possible to constantly monitor the position of the lateral edge of the sheet with the assistance of the first edge sensor and to continuously readjust the transport device upon displacement. Given simultaneous employment of a first and second edge sensor, it is possible to identify not only the offset of the sheet but is also possible to determine whether the recording medium is being pulled in at an angle by comparing the positional values simultaneously determined by the two edge sensors. In particular, simple light barriers or, on the other hand, light-sensitive arrangements such as CCD arrays are suitable as edge sensors.

The transport device is preferably displaced with a first drive transversely relative to the conveying direction of the recording medium. In particular, servo drives are suitable as first drive since these can be very exactly driven. Further, stepping motors are proposed as drives for the transport device since these can be very exactly positioned by counting the individual control pulses and the position of the transport device can be simultaneously determined by counting the individual control pulses.

In a preferred embodiment of the aligning device, the first transport unit of the transport device is a transport roller extending transversely relative to the conveying direction. At least one counter-pressure roller lying against the transport roller under pre-stress is employed as second transport unit. Both the transport roller as well as the counter-pressure roller can be fashioned with an elastic coating, so that the sheet can be reliably held. In this embodiment, the transport ensues with a second drive that moves the transport roller. Here, too, for example, a servo drive or a stepping motor is suitable as drive. Further, what are referred to as tractor units can be employed as transport units, these pulling the recording medium in the alignment means with conveyor belts.

In an embodiment, the present invention provides an aligning device which comprises a sensor device for detecting the lateral edge of the sheet of paper and determining a position of the lateral edge relative to a predetermined printing position. The device further comprises a transport device that comprises first and second transport units disposed opposite one another and contacting one another along a contact line extending transversely relative to the conveying direction. The contact line forms a detent for receiving the leading edge of the sheet and aligning the leading edge of the sheet to a perpendicular position with respect to the conveying direction. The transport device is movable transversely relative to the conveying direction. The aligning device further comprises a delivery device for conveying the sheet to the transport device. The delivery device is movable between a transport position and an open position. In the transport position, the delivery device conveys the sheet along the conveying direction until the leading edge engages the detent formed by the transport units of the transport device and the sheet arcs between the delivery device and the transport device. In the open position, the delivery device releases the sheet thereby allowing the sheet to assume a flat position as it extends between the delivery device and the transport device.

In an embodiment, the delivery device comprises two conveyor units extending transversely relative to the conveying direction and one of the conveyor units is movable between the transport position and the open position.

In an embodiment, the delivery device further comprises at least one delivery tensing element that biases the movable conveyor unit into the transport position. The delivery device further comprising at least one actuator unit for moving the movable conveyor unit into the open position thereby overcoming the bias of the delivery tensing element.

In an embodiment, the transport device further comprises a transport tensing element that biases the transport device into an initial position and at least one actuator driver for moving the transport device opposite the bias of the transport tensing device.

In an embodiment, the sensor device comprises a first edge sensor disposed between the delivery device and the transport device.

In an embodiment, the sensor device further comprises a second edge sensor disposed downstream of the transport device.

In an embodiment, the aligning device further comprises a conveyor device disposed downstream of the transport device.

In an embodiment, the first and second transport units comprise a transport roller and a counter-pressure roller respectively.

In an embodiment, the transport roller is driven with a roller driver.

In an embodiment, the transport and counter-pressure rollers are biased in an initial position by the transport tensing device and the transport and counter-pressure rollers are movable transversely relative to the conveying direction and opposite the bias of the transport tensing device by an actuator driver.

In an embodiment, the transport tensing device comprises two leaf springs disposed parallel to one another and at opposing ends of the transport roller.

Other objects and advantages of the present invention will become apparent from reading the following detailed description and appended claims, and upon reference to the accompanying drawings.

BRIEF DESCRIPTION OF THE DRAWINGS

An exemplary embodiment of the invention is explained in greater detail below with reference to the drawings. Shown therein are.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
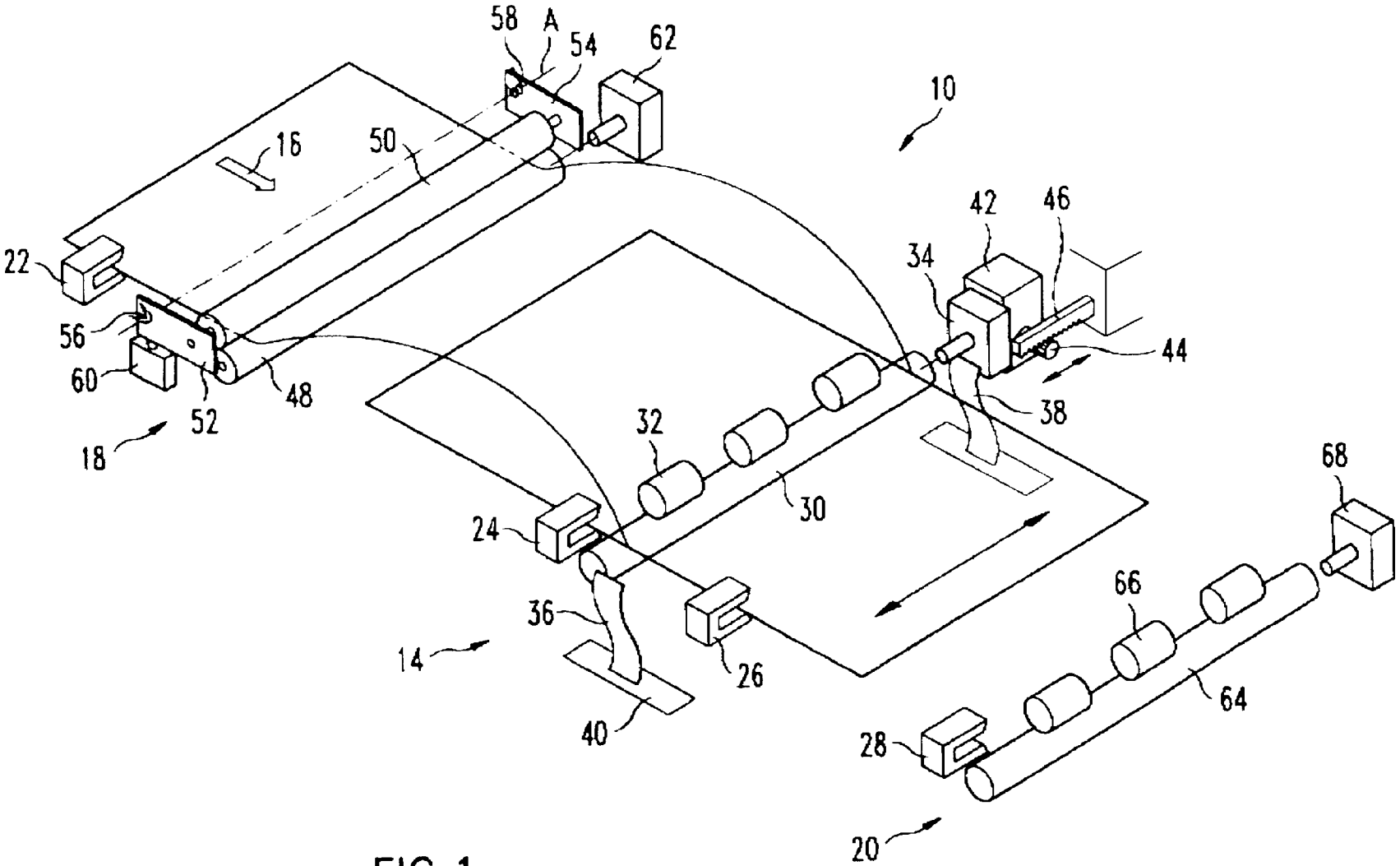
FIG. 1 is a schematic illustration of an aligning device of the invention.

FIG. 1 shows a schematic illustration of an exemplary embodiment of an aligning device 10 that serves the purpose of aligning a single sheet 12 of a recording medium of paper. The aligned device 10 has a transport device 14 shown roughly in the middle in FIG. 1, a delivery device 18 arranged preceding the transport device 14 as viewed in conveying direction 16 of the sheet 12, as well as a conveyor device 20 that follows the transport device 14 in conveying direction 16. Further, the aligned device 10 is equipped with a total of four light barriers 22, 24, 26 and 28. As viewed in conveying direction 16, the first light barrier 22 is arranged immediately before the delivery device 18 and outputs a signal to the control (not shown) of the aligning device 10 as soon as the sheet 12 is placed into the aligning device 10. The second and third light barrier 24 and 26 are arranged in the immediately proximity of the transport device 14. As viewed in conveying direction 16, the second light barrier 24 is positioned preceding the transport device 14 and acquires the sheet 12 as soon as it is supplied to the transport device 14. As viewed in conveying direction 16, the third light barrier 26 is arranged following the transport device 14 and serves the purpose of identifying the lateral edge of the sheet 12 as soon as the sheet 12 has been ceased by the transport device 14. As viewed in conveying direction 16, the fourth light barrier 28 is secured immediately preceding the conveyor device 20 that ceases the sheet 12 as soon as it is supplied to the conveyor device 20. The employment of the light barriers 22, 24, 26 and 28 assures that only one sheet 12 is located in the aligning device 10 during the alignment of the sheet 12 by the transport device 14, as shall be explained later.

The transport device 14 employs a transport roller 30 seated in a frame (not shown) that extends transversely relative to the conveying direction 16 of the sheet 12. Three counter-pressure rollers 32 likewise held in the frame are seated above the transport roller 30, these pressing against the transport roller 30 with pre-stress and forming a conveying nip together with them through which the sheet 12 is conveyed. A roller drive 34 is arranged at what is the right face side of the transport roller 30 shown in FIG. 1. This roller drive 34 places the transport roller 30 into rotation during the transport of the sheet 12, so that the sheet 12 is conveyed by the counter-pressure rollers 32 lying against the transport roller 30 under pre-stress.

The frame of the transport device 14 is held in guide rails (not shown) proceeding transversely relative to the conveying direction 16 of the sheet 12. The one end of a leaf spring 36 or, respectively, 38 is respectively secured at each end face of the frame of the transport device 14. The other end of the leaf spring 36 or, respectively, 38 is rigidly connected to the frame 40 of the aligning device 10. Immediately following the roller driver 34, an actuator driver 42 is secured thereto, the drive shaft 44 thereof extending in conveying direction 16. The drive shaft 44 is equipped with a toothing that meshes with a toothed rack 46 that is secured to the frame 40 of the aligning device 10 and extends transversely relative to the conveying direction 16. When the actuator drive 42 is activated by the control (not shown) of the aligning device 10, the transfer device 14, due to the interaction of the drive shaft 44 with the tooth rack 46, is moved transversely to the conveying direction 16 along the guides opposite the force of the leaf springs 36 and 38. When the actuator drive 42 is de-activated, the transport means 14 returns into its initial position under the influence of the leaf springs 36 and 38.

The delivery device 18 employs a delivery roller 48 extending transversely relative to the conveying direction 16, this being rotatably seated in a frame (not shown). A counter-pressure roller 50 is arranged above the delivery roller 48. The counter-pressure roller 50 has each of its ends rotatably seated at a pivotable plate 52 or, respectively, 54. The pivotable plates 52 and 54 are secured to a common shaft A that is in turn rotatably seated at the frame (not shown). Further, a coil spring 56 or, respectively, 58 is slipped onto the shaft A at every plate 52 or, respectively, 54. As a result of these two coil springs 56 and 58, the pivotable plates 52 and 54 and, thus, the counter-pressure roller 50 are pre-stressed in the direction of the delivery roller 48, so that the counter-pressure roller 50 lies against the delivery roller 48 under pre-stress in a transport position wherein the sheet 12 can be transported by the delivery device 18. Further, an actuator element 60 is provided at each of the pivotable plates 52 and 54, only the actuator element 60 of the plate 52 shown at the left being visible in FIG. 1 thereof. With the assistance of the actuator element 60, the counter-pressure roller 50 can be moved opposite the force of the coil springs 56 and 58 into an open operating position in which it is held at a distance from the delivery roller 48. The delivery roller 48 is placed into rotation with a delivery roller drive 62, so that the sheet 12 arranged between the delivery roller 48 and the counter-pressure roller 50 pressing thereagainst is conveyed. The conveyor device 20 likewise employs a conveyor roller 64 extending transversely relative to the conveying direction 16 and against which three counter-pressure roller 66 lie under pre-stress. The conveyor roller 64 is placed into rotation with a conveyor roller drive 68, so that the sheet 12 arranged between the conveyor roller 64 and the counter-pressure rollers 66 is conveyed.

The functioning of the aligning device 10 shall be explained in greater detail below with reference to FIGS. 1 and 2. As soon as a single sheet 12 of a recording medium is placed into the aligning device 10, the first light barrier 22 acquires the lateral edge of the sheet 12 shown at the left in FIG. 1 and outputs a signal to the control (not shown) of the aligning device 10. As a result of the signal of the first light barrier 22, the control activates the delivery roller drive 62 for the delivery device 18, as a result whereof the delivery roller 48 pivoted into the transport position is placed into rotation and draws the sheet 12 into the aligning device 10. As soon as the second light barrier 24 acquires the leading edge of the sheet 12 conveyed into the aligning device 10, it forwards this signal to the control.

If another sheet is in the aligning device 10, the control stops the delivery device 18 until the fourth light barrier 28 has detected that the further sheet has left the aligning device 10. When the further sheet has left the aligning device 10, the control deactivates the roller drive 34 and moves the transport device 14 back into its initial position with the assistance of the actuator drive 42, i.e. approximately centrally relative to the conveying path. Subsequently, the control re-activates the delivery device 18, so that the sheet 12 to be aligned is drawn farther into the aligning device 10. If no further sheet was located in the aligning device 10 at the time that the control acquired the signal of the second light barrier 22, the delivery device 18 is not stopped but draws the sheet 12 into the aligning device 10 without interruption.

As soon as the sheet 12 to be aligned proceeds into the transport device 14, its leading edge pushes itself into the conveying nip between transport roller 30 and counter-pressure roller 32. The contact line (shown as a dot-dashed line) between the transport roller 30 and the counter-pressure rollers 32 lying thereagainst thereby forms a detent at which the leading edge of the sheet 12 aligns itself. Since the delivery device 18 continues to convey the sheet 12 into the aligning device 10, the sheet 12 arcs between the delivery device 18 and the transport device 14, as shown in FIG. 1. After a predetermined time span, the control of the aligning device 10 arrests the delivery device 18, so that the sheet is held by the delivery device 18 and, due to the stresses in the sheet 12 caused by the arcing, simultaneously aligns the leading edge at the contact line. Subsequently, the control activates the roller driver 34 of the transport device 14, so that the sheet 12 is drawn into the aligning device 10. As soon as the third light barrier 26 detects the leading edge of the sheet 12, the control arrests the transport device 14. Subsequently, the control actuates the actuator elements 60 of the delivery device 18, as a result whereof the counter-pressure roller 50 is moved out of its transport position in which it lies against the delivery roller 48 under pre-stress into the open operating position wherein it is held at a distance from the delivery roller 48. As a result of this opening motion, the delivery device 18 releases the sheet 12 that relaxes and again proceeds flat along the conveying direction 16. Subsequently, the transport device 14 begins the aligning procedure that is explained in greater detail below with reference to FIG. 2.

Figure 2:
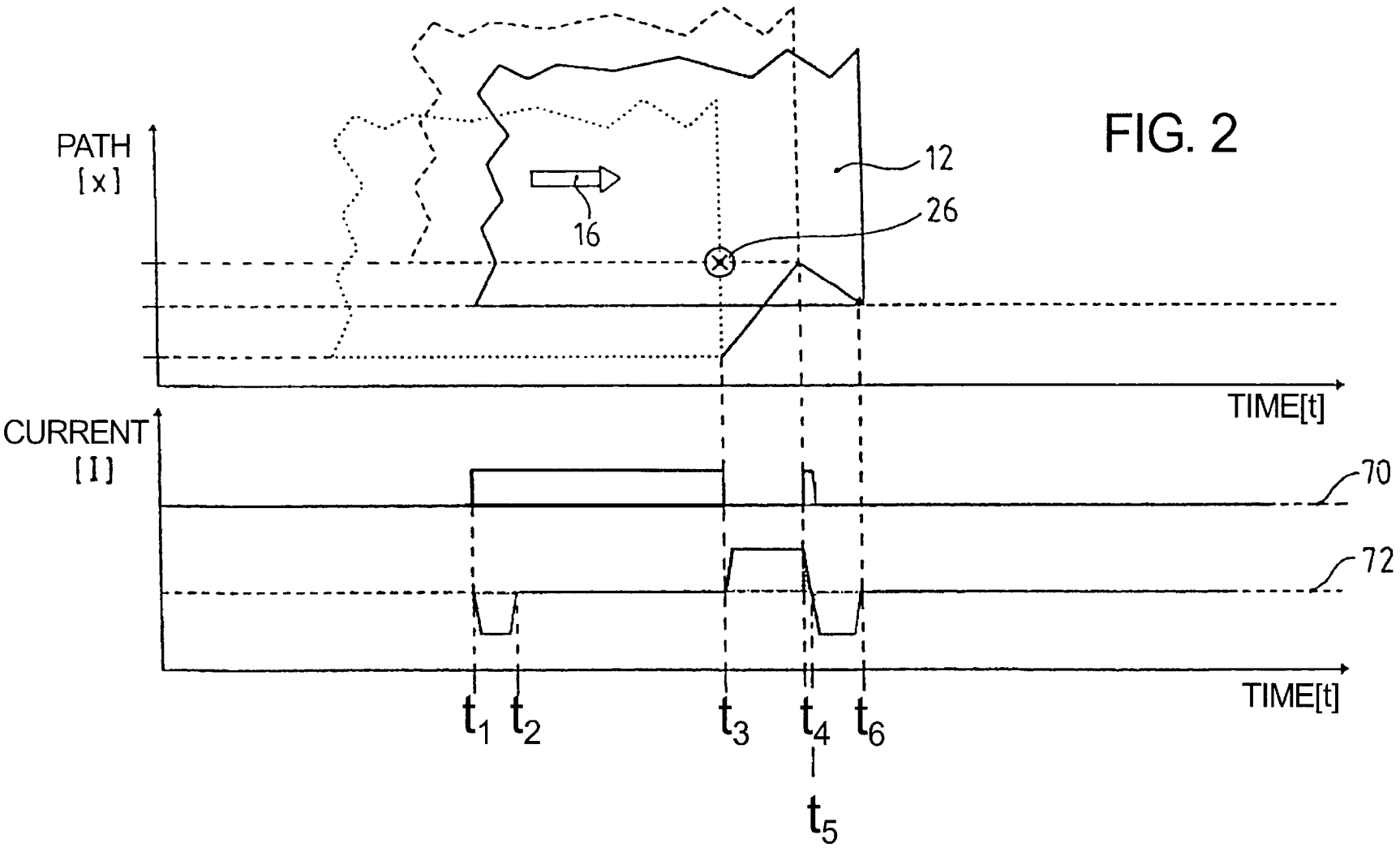
FIG. 2 is a schematic illustration of the procedures when aligning a single sheet of a recording medium.

FIG. 2 shows the actual aligning procedure of the sheet 12. FIG. 2 shows a path-time diagram and a current-time diagram arranged under the former.

The path-time diagram shows the aligning procedure of the sheet 12 in plan view, whereby the different positions of the sheet are shown dotted, dashed or, respectively, in a solid line. The rated printing position, which is referenced $X_D$ at the path axis, proceeds parallel to the time axis with a dashed line. The value $X_0$ at the axis defines the starting position of the sheet 12 when this is drawn into the aligning device 10. The value $X_L$ defines a predetermined distance of the third light barrier 26 from the rated printing position, which should like at 6 mm in the exemplary embodiment.

The current-time diagram shows the signal curve 70 of the light barrier 26 and the signal curve 72 of the actuator drive 42 with which the transport device 14 is moved transverse relative to the conveying direction 16. At time $t_1$ the sheet previously aligned by the aligning device 10 has left the transport device 14. Since the light barrier 26 is no longer interrupted, it generates a signal (shown hatched). The actuator drive 42 is activated as soon as the light barrier 26 informs the control that the sheet has left the transport device 14, as shown in the signal curve 72 as a result whereof the transport device 14 is moved back into its initial position. The restoring movement of the transport device 14 is ended at time $t_2$.

At time $t_3$, the third light barrier 26 acquires the sheet 12 to be newly aligned that is drawn into the transport device 14 with an initial position $X_0$. The third light barrier 26 is thereby interrupted, which can be seen in the signal curve 70. As soon as the control—at time $t_3$—detects the signal of the third light barrier 26, it moves the delivery device 18 into the open position that releases the sheet 12 and subsequently activates the actuator drive 42 that moves the entire transport device 14 and, thus, the sheet 12 to be aligned as well toward the left transversely relative to the conveying direction 16. At time $t_4$, the sheet 12 has been moved toward the left to such an extent that its position corresponds to the position $X_L$ of the third light barrier 26, this is no longer interrupted by the sheet 12 and generates a signal, as shown in the signal curve 70. As a result thereof, the control recognizes that the sheet 12 is located at the level of the third light barrier 26 and arrests the actuator drive drive 42.

Subsequently, at time $t_5$, the control activates the actuator drive 42 such that this moves the transport device 14 and, thus, the sheet 12 toward the right transversely relative to the conveying direction. The actuator drive 42 is thereby driven by the control with a constant speed over a predetermined time span. After the expiration of this time span at time $t_6$, the control arrests the actuator drive 42, so that the transport device 14 and, thus, the sheet 12 remains in a specific position transversely relative to the conveying direction 16. Since the actuator drive 42 was activated with constant speed over a predetermined time span, the sheet 12 was moved toward the right by a predetermined path length. This path length corresponds to the distance of the third light barrier 26 from the rated printing position $X_D$, so that the sheet 12—after point in time $t_6$—has its right-hand lateral edge located at the level of the rated printing position $X_D$.

After the sheet 12 has been properly aligned, the control activates the roller drive 34 of the transport device 14 as well as the conveyor roller drive 68 of the conveyor device 20. As a result thereof, the sheet 12 is transported out of the aligning device 10. As soon as the second light barrier 24 detects the trailing edge of the sheet 12, the control deactivates the actuator elements 60 of the delivery device 18, as a result whereof the counter-pressure roller 50 is again moved into its transport position due to the force of the coil springs 56 and 58.

LIST OF REFERENCE CHARACTERS

10 Aligning device
12 Sheet of a recording medium
14 Transport device
16 Conveying direction
18 Delivery device
20 Conveying device
22 First light barrier
24 Second light barrier
26 Third light barrier
28 Fourth light barrier
30 Transport roller
32 Counter-pressure rollers
34 Roller drive
36 Leaf spring
38 Leaf spring
40 Frame of the aligning device
42 Actuator drive
44 Drive shaft
46 Toothed rack
48 Delivery roller
50 Counter-pressure roller
52 Pivotable plates
54 Pivotable plates
A Axis
56 Coil spring
58 Coil spring
60 Actuator element
62 Delivery roller drive
64 Conveyor roller
66 Counter-pressure rollers
68 Conveyor roller drive
70 Signal curve of the third light barrier 26
72 Signal curve of the actuator drive 42

From the above description, it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed is:

1. An aligning device for aligning a single sheet of a recording medium, the single sheet having a leading edge generally perpendicular to a conveying direction and a lateral edge generally parallel to the conveying direction, the aligning device comprising:

a sensor device for detecting the lateral edge of the sheet and determining a position of the lateral edge relative to a predetermined printing position, a transport device comprising first and second transport units disposed opposite one another and contacting one another along a contact line extending transversely relative to the conveying direction, the contact line forming a detent for receiving the leading edge of the sheet and aligning the leading edge of the sheet to a perpendicular position with respect to the conveying direction, the transport device being movable transversely relative to the conveying direction, a delivery device for conveying the sheet to the transport device, the delivery device being movable between a transport position and an open position, in the transport position, the delivery device conveying the sheet along the conveying direction until the leading edge engages the detent formed by the transport units of the transport device and the sheet arcs between the delivery device and the transport device, in the open position, the delivery device releasing the sheet and allowing the sheet to assume a flat position as the sheet extends between the delivery device and the transport device.

2. The aligning device of claim 1 wherein the delivery device comprises two conveyor units extending transversely relative to the conveying direction, and one of the conveyor units being movable between the transport position wherein the two conveyor units engage one another and the open position wherein one of the conveyer units is spaced apart from the other conveyor unit.

3. The aligning device of claim 2 wherein the delivery device further comprises at least one delivery tensing element that biases the movable conveyor unit into the transport position, the delivery device further comprising at least one actuator unit for moving the movable conveyor unit into the open position thereby overcoming the bias of the delivery tensing element.

4. The aligning device of claim 1 wherein the transport device further comprises a transport tensing device that biases the transport device into an initial position and at least one actuator driver for moving the transport device opposite the bias of the transport tensing device.

5. The aligning device of claim 4 wherein the sensor device comprises a first edge sensor disposed between the delivery device and the transport device, the first edge sensor detecting the lateral edge of the sheet and determining the position thereof relative to the predetermined printing position.

6. The aligning device of claim 5 wherein the sensor device further comprises a second edge sensor disposed downstream of the transport device.

7. The aligning device of claim 6 wherein the second edge sensor comprises a CCD array.

8. The aligning device of claim 5 wherein the first edge sensor comprises a CCD array.

9. The aligning device of claim 4 wherein the actuator driver is selected from the group consisting of a servo drive and a stepping motor.

10. The aligning device of claim 1 further comprising a conveyor device disposed downstream of the transport device.

11. The aligning device of claim 1 wherein the first transport unit comprises a transport roller extending transversely relative to the conveying direction, and the second transport unit comprises at least one counter-pressure roller engaging the transport roller, whereby the contact line between the transport and counter-pressure rollers forms the detent for the leading edge of the sheet.

12. The alignment device of claim 11 wherein the transport roller is driven with a roller driver.

13. The aligning device of claim 12 wherein transport and counter-pressure rollers are biased in an initial position with a transport tensing device, and the transport and counter-pressure rollers being movable transversely relative to the conveying direction and opposite the bias of the transport tensing device by an actuator driver.

14. The aligning device of claim 13 wherein the transport tensing device comprises two leaf springs disposed parallel to one another and at opposing ends of the transport roller.

15. The aligning device of claim 12 wherein the roller driver is selected from the group consisting of a servo drive and a stepping motor.

16. An aligning device for aligning a single sheet of a recording medium, the single sheet having a leading edge generally perpendicular to a conveying direction and a lateral edge generally parallel to the conveying direction, the aligning device comprising:

a sensor device for detecting the lateral edge of the sheet and determining a position of the lateral edge relative to a predetermined printing position, a transport device comprising a transport roller and a counter-pressure roller disposed opposite one another and contacting one another along a contact line extending transversely relative to the conveying direction, the contact line forming a detent for receiving the leading edge of the sheet and aligning the leading edge of the sheet to a perpendicular position with respect to the conveying direction, the transport roller being driven with a roller driver, the transport and counter-pressure rollers being biased in an initial position with a transport tensing device, and the transport and counter-pressure rollers being movable transversely relative to the conveying direction and opposite the bias of the transport tensing device by an actuator driver, a delivery device for conveying the sheet to the transport device, the delivery device comprising two conveyor units extending transversely relative to the conveying direction, one of the conveyor units being movable between a transport position and an open position, wherein, in the transport position, the two conveyor units engage one another thereby conveying the sheet along the conveying direction until the leading edge engages the detent formed by the transport units of the transport device and the sheet arcs between the delivery device and the transport device, wherein, in the open position, the moveable conveyer unit is spaced apart from the other conveyor unit thereby releasing the sheet and allowing the sheet to assume a flat position as the sheet extends between the delivery device and the transport device, the delivery device further comprises at least one delivery tensing element that biases the movable conveyor unit into the transport position and at least one actuator unit for moving the movable conveyor unit into the open position thereby overcoming the bias of the delivery tensing element.

17. The aligning device of claim 16 wherein the sensor device comprises a first edge sensor disposed between the delivery device and the transport device, the first edge sensor detecting the lateral edge of the sheet and determining the position thereof relative to the predetermined printing position.

18. The aligning device of claim 17 wherein the sensor device further comprises a second edge sensor disposed downstream of the transport device.

19. The aligning device of claim 16 further comprising a conveyor device disposed downstream of the transport device.

20. The aligning device of claim 16 wherein the transport tensing device comprises two leaf springs disposed parallel to one another and at opposing ends of the transport roller.

* * * * *